US012083374B1

(12) United States Patent
Womack

(10) Patent No.: US 12,083,374 B1
(45) **Date of Patent: *Sep. 10, 2024**

(54) SUPPORT GARMENT FOR RESISTANCE EXERCISE

(71) Applicant: Michael Womack, Mckinney, TX (US)

(72) Inventor: Michael Womack, Mckinney, TX (US)

( * ) Notice: Subject to any disclaimer, the term of this patent is extended or adjusted under 35 U.S.C. 154(b) by 70 days.

This patent is subject to a terminal disclaimer.

(21) Appl. No.: 17/985,825

(22) Filed: Nov. 12, 2022

Related U.S. Application Data

(63) Continuation-in-part of application No. 16/565,402, filed on Sep. 9, 2019, now Pat. No. 11,497,259, which is a continuation-in-part of application No. 14/555,427, filed on Nov. 26, 2014, now Pat. No. 10,405,589.

(60) Provisional application No. 63/395,846, filed on Aug. 7, 2022.

(51) Int. Cl.
*A63B 21/055* (2006.01)
*A63B 21/00* (2006.01)

(52) U.S. Cl.
CPC .... *A63B 21/0552* (2013.01); *A63B 21/00178* (2013.01); *A63B 21/4005* (2015.10); *A63B 21/4007* (2015.10); *A63B 21/4025* (2015.10)

(58) Field of Classification Search
CPC ..... A63B 21/0552; A63B 21/4005; A63B 21/4007; A63B 21/4025; A63B 21/00178
See application file for complete search history.

(56) References Cited

U.S. PATENT DOCUMENTS 1,639,198 A * 8/1927 Merrick ..... A61F 5/14 602/65
2,986,740 A * 6/1961 Schudson ..... A41D 27/10 2/93
3,116,735 A 1/1964 Geimer
3,324,851 A * 6/1967 Posner ..... A61F 5/3723 473/215
3,548,818 A * 12/1970 Kaplan ..... A61F 13/146 2/45
3,724,846 A * 4/1973 Perrine ..... A63B 71/12 482/106
4,273,328 A * 6/1981 Ozbey ..... A63B 21/0552 482/139

(Continued)

*Primary Examiner* — Richale L Quinn
(74) *Attorney, Agent, or Firm* — Michael Diaz

(57) ABSTRACT

A support garment for use during resistance training. The support garment includes a band of elastomeric material having a front perimeter and a rear perimeter. The front perimeter includes a first perimeter side and a second perimeter side opposite the first perimeter side. A portion of the first perimeter side of the front perimeter is attached to a portion of the second perimeter side of the front perimeter at a seam. A first opening is formed on a first seam side of the seam and a second opening is formed on a second seam side opposite the first side of the seam. The support garment includes two upper arm sleeves, each encompassing one of the openings. Each upper arm sleeve is configured for wear on an upper arm of a user above an elbow of the user. The upper arm sleeves are biased inwardly. Each upper arm sleeve is configured to position one arm in one of the upper arm sleeves and the front perimeter is configured to position the front perimeter across a chest of the user during resistance training.

12 Claims, 14 Drawing Sheets

(56) References Cited

U.S. PATENT DOCUMENTS 4,369,775 A * 1/1983 Gamm ..... A61F 13/10 602/65
4,412,357 A * 11/1983 Mincher ..... A41D 13/0017 2/118
4,570,929 A * 2/1986 Shoemaker ..... A63B 21/0552 112/475.08
4,741,719 A * 5/1988 Wirth ..... A41D 31/185 450/79
4,890,841 A * 1/1990 Brooks ..... A63B 69/0059 473/212
4,993,705 A * 2/1991 Tolle ..... A63B 21/4043 482/139
5,308,305 A * 5/1994 Romney ..... A63B 21/4021 482/121
5,573,487 A * 11/1996 Wallner ..... A63B 21/4025 482/122
5,624,388 A * 4/1997 Lehr ..... A61F 5/0118 602/20
6,047,406 A * 4/2000 Dicker ..... A63B 21/4025 2/69
6,231,488 B1 * 5/2001 Dicker ..... A63B 21/0004 482/121
6,364,614 B1 * 4/2002 Mnatsakanian ..... B63H 1/26 416/223 R
6,892,396 B2 * 5/2005 Uno ..... A41B 9/06 2/115
D537,609 S * 3/2007 Horowitz ..... D2/500
D620,252 S * 7/2010 Keels ..... D3/247
7,908,670 B2 * 3/2011 Semba ..... A41D 1/04 2/69
8,312,566 B2 * 11/2012 Weir ..... A41D 13/0015 2/69
D678,434 S * 3/2013 Hughes ..... D21/692
8,454,484 B2 * 6/2013 Keen ..... A63B 21/02 24/298
8,771,155 B1 * 7/2014 Bell ..... A63B 21/0428 482/125
9,009,863 B2 * 4/2015 Decker ..... A41D 31/185 2/45
D748,209 S * 1/2016 Alaniz, III ..... D21/662
9,655,389 B2 * 5/2017 Blakely ..... A41D 13/0015
10,363,452 B2 * 7/2019 Alaniz, III ..... A41D 31/18
D908,969 S * 1/2021 Forell ..... D29/101.3
10,912,374 B2 * 2/2021 Hopple ..... A45F 5/1046
D922,688 S * 6/2021 Forell ..... D29/101.3
2008/0214330 A1 * 9/2008 Goebel ..... A63B 21/0442 482/44
2009/0062704 A1 * 3/2009 Brown ..... A61F 5/026 602/19
2010/0050313 A1 * 3/2010 Shackelford, Jr. ..... A41D 13/1245 2/243.1
2012/0295777 A1 * 11/2012 Zaki ..... A63B 21/4015 482/122
2014/0171275 A1 * 6/2014 Tatum ..... A63B 21/0004 482/124
2018/0256937 A1 * 9/2018 McCracken ..... A63B 69/0059

* cited by examiner

SUPPORT GARMENT FOR RESISTANCE EXERCISE

RELATED APPLICATIONS

This application is a continuation-in-part application of U.S. patent application Ser. No. 16/565,402 filed on Sep. 9, 2019, which is a continuation-in-part application of Ser. No. 14/555,427 filed on Nov. 26, 2014, under the name of Michael Womack which hereby incorporated by reference. In addition, this application claims the benefit of U.S. Provisional Patent Application Ser. No. 63/395,846 filed on Aug. 7, 2022, by Michael Womack and also is hereby incorporated by reference.

BACKGROUND OF THE INVENTION

Field of the Invention

This invention relates to clothing. Specifically, and not by way of limitation, the present invention relates to a garment to provide support for use during resistance training, such as weight training.

Description of the Related Art

Resistance training, such as weight training, weightlifting, or powerlifting is an excellent form of exercise, sport, and form of rehabilitation for injured patients. However, with the use of weights or other resistance devices, there is an inherent risk to damaging a person's shoulders during various resistance exercises. In one example, in the sports of weightlifting and powerlifting, a popular event is bench pressing where an individual attempts to bench press a maximum weight. Unfortunately, the geometry of the movement of the heavy weight places extreme stress on the individual's shoulders. To assist in the reduction of this stress, many participants in this event utilize support garments providing a tight fit over the entire upper torso of the individual, thereby reducing some of the stress on the shoulders. These shirt garments are typically constructed of a heavy elastic material and fit very tightly around the individual. It is often very difficult to remove and put on these shirt garments. Additionally, although these existing garments assist in supporting the individual during the lift, even more support is needed to further reduce the stress to the individual to avoid injury during the bench press event.

Although there are no known prior art teachings of a garment such as that disclosed herein, a prior art reference that discusses subject matter that bears some relation to matters discussed herein is U.S. Pat. No. 8,771,155 to Bell (Bell). Bell discloses an exercise apparatus having two arm cuffs and a central rectangular-shaped piece of material connecting the two arm cuffs. The cuffs are sized and shaped to fit over the arms and cover the elbows of the user. Although the Bell apparatus does provide some support to the user during resistance exercise, Bell suffers from several disadvantages. The Bell apparatus provides limited support to the user as support is merely providing at a region of the person's elbows and the areas adjacent to the elbows. Furthermore, the apparatus cannot be worn under a shirt, and must be worn outside of any other clothing, thereby negating the use of the apparatus during a competition.

It would be advantageous to have a garment which provides greater support to an individual during various weight resistance exercises, which may be worn by the user without restriction. It is an object of the present invention to provide such a garment.

SUMMARY OF THE INVENTION

In one aspect, the present invention is directed to a support garment for use during resistance training. The support garment includes a band of elastomeric material having a front perimeter and a rear perimeter. The front perimeter includes a first perimeter side and a second perimeter side opposite the first perimeter side. A portion of the first perimeter side of the front perimeter is attached to a portion of the second perimeter side of the front perimeter at a seam. A first opening is formed on a first seam side of the seam and a second opening is formed on a second seam side opposite the first side of the seam. The support garment includes two upper arm sleeves, each encompassing one of the openings. Each upper arm sleeve is configured for wear on an upper arm of a user above an elbow of the user. The upper arm sleeves are biased inwardly. Each upper arm sleeve is configured to position one arm in one of the upper arm sleeves and the front perimeter is configured to position the front perimeter across a chest of the user during resistance training.

DESCRIPTION OF THE INVENTION

Figure 1:
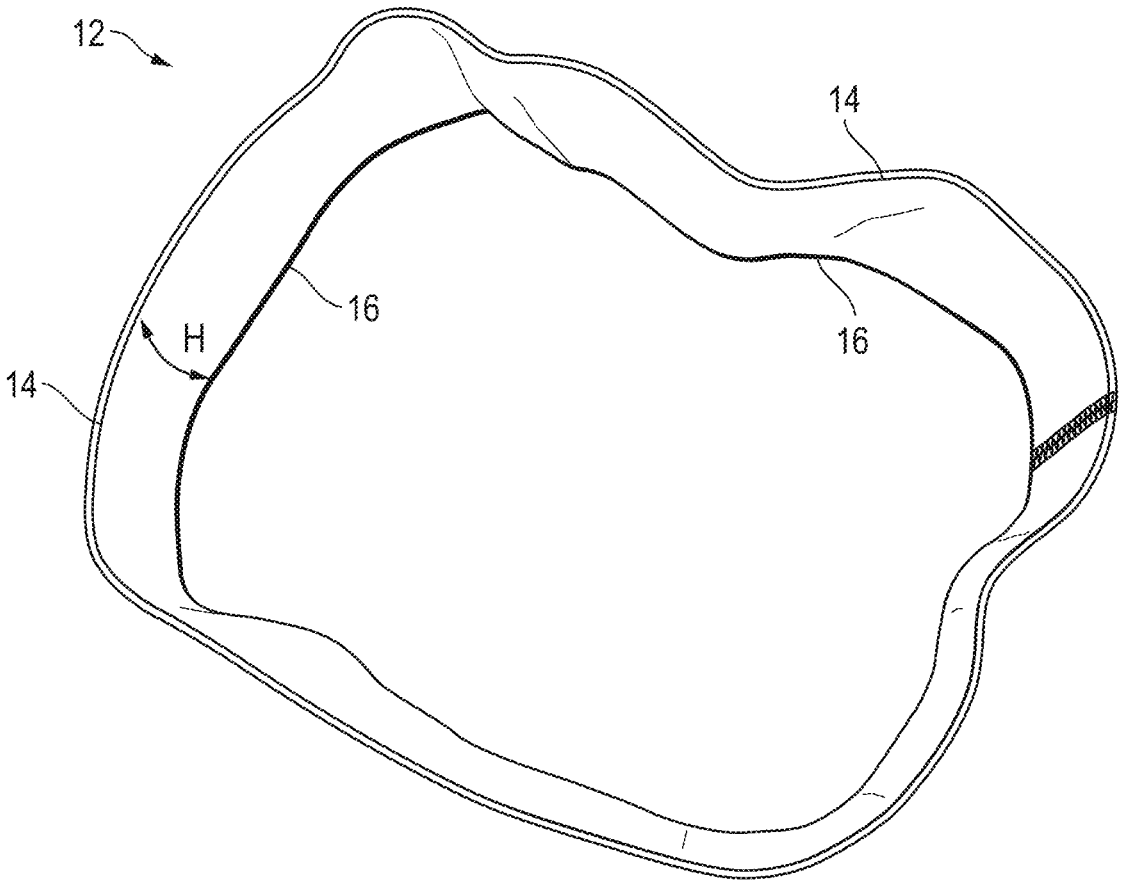
FIG. 1 is a top view of a band of material of a support garment in one embodiment of the present invention.
Figure 2:
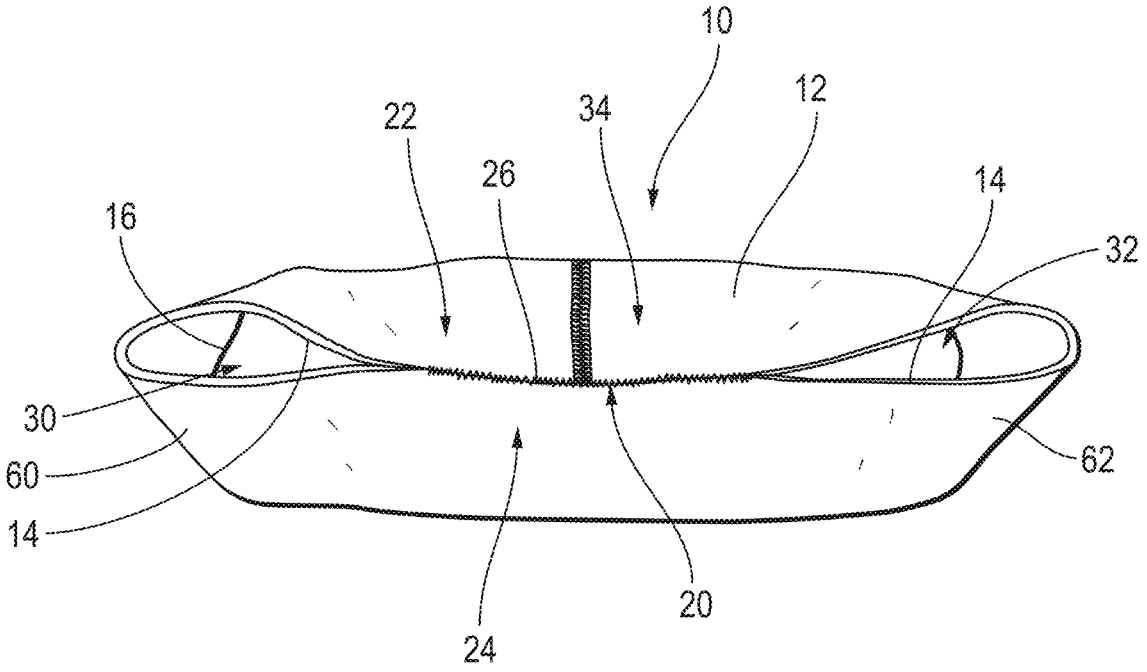
FIG. 2 is a front perspective view of the band of material of FIG. 1.

The present invention is a garment providing support during weight resistance events. FIG. 1 is a top view of a band of material 12 of a support garment 10 in one embodiment of the present invention. FIG. 2 is a front perspective view of the band of material 12 of FIG. 1. The band of material 12 includes a front perimeter 14 and a rear perimeter 16 and having a height H. FIG. 2 is a front view of the band 12 attached at a seam 20. Portions of the band are attached together at a portion of the seam. Preferably, the seam is created by sewing a first side 22 on front perimeter 14 to an opposite side 24 located on the front perimeter 14 of the band. In one embodiment, the seam is located at an edge 26 of the band leaving arm openings 30 and 32 where the arms of the user are positioned through. The chest of the user is positioned adjacent a frontal portion 34 of the support band, located between the openings 30 and 32 at the seam 20. The openings 30 and 32 are configured where each opening is sized and shaped to fit around the appropriate upper arm of a user. The portions of the band surrounding the openings function as arm sleeves 60 and 62. Preferably, the arm sleeves are positioned above each elbow of the user. The support garment may be constructed of a strong elastic material. In one embodiment, the elastic material is constructed from a material consisting of 70 percent elasticity and 30 percent cotton. However, the present invention may be constructed of an elastic material allowing support to the user of the support garment during resistance training.

Figure 3:
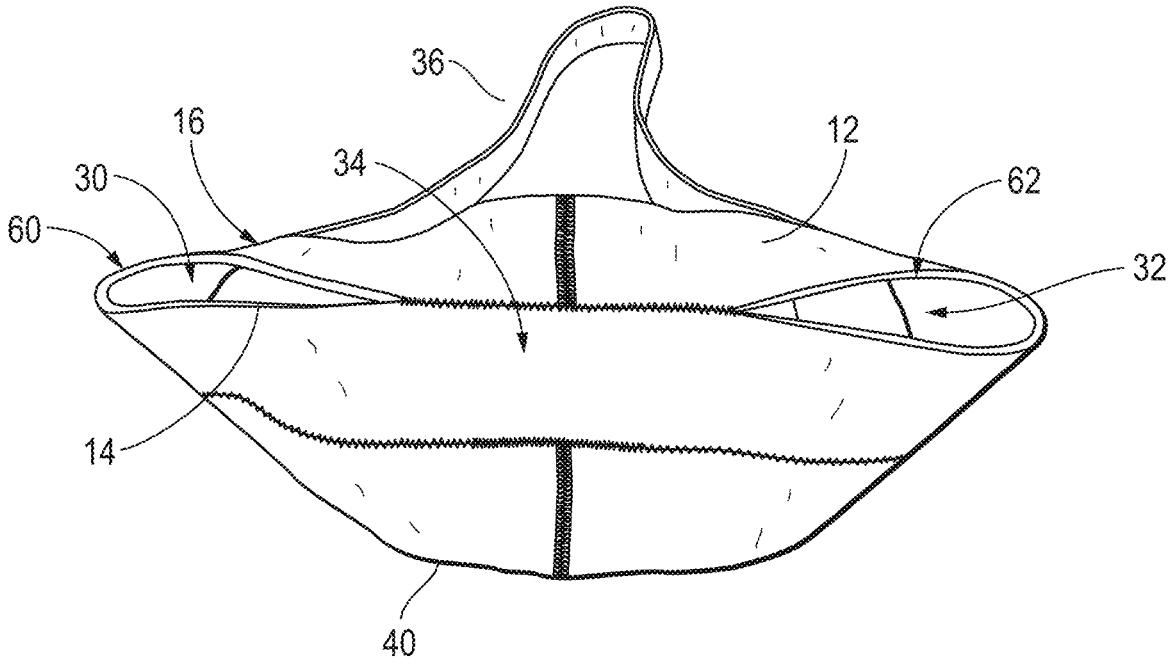
FIG. 3 is a second front view of the garment of FIG. 2 illustrating an optional back strap in an alternate embodiment of the present invention.
Figure 4:
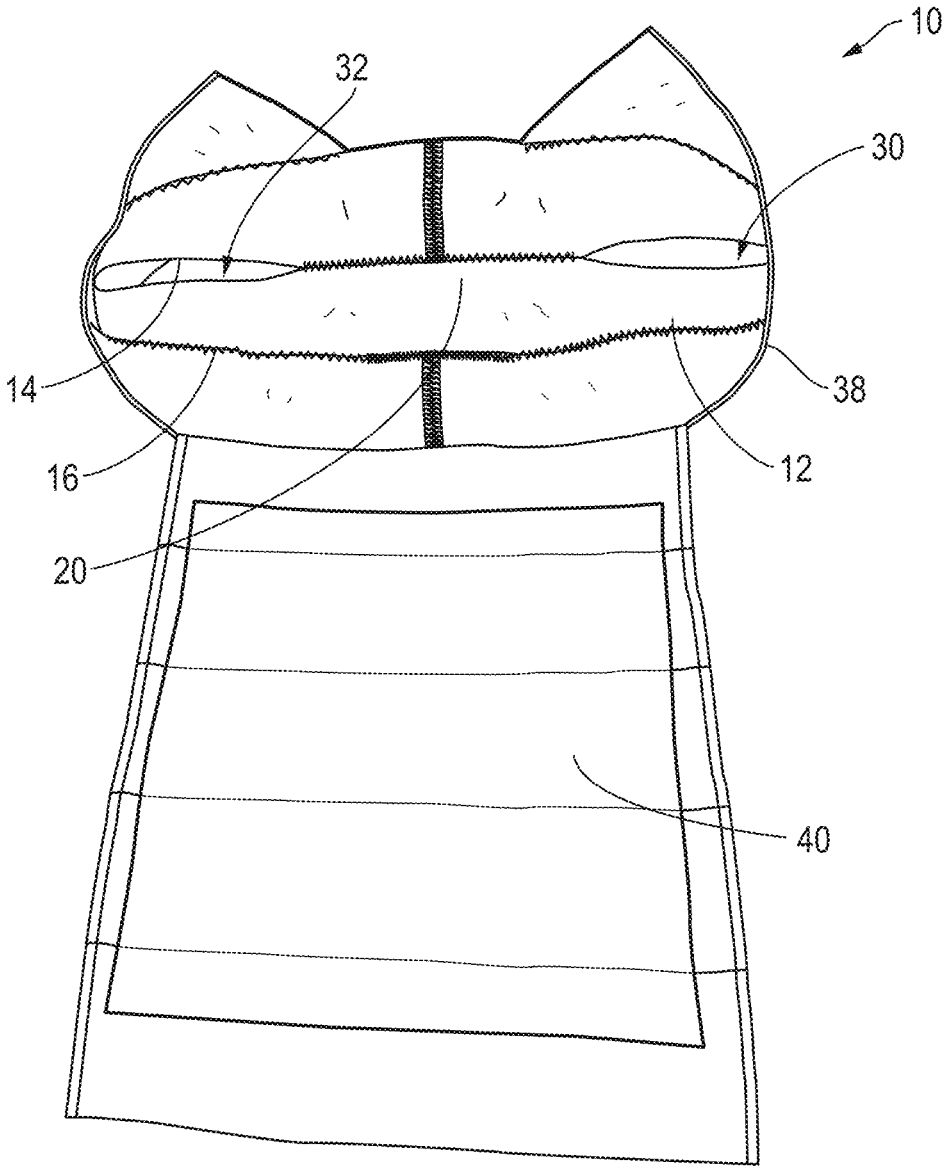
FIG. 4 is a rear view of the support garment having a front bib in an alternate embodiment of the present invention.

FIG. 3 is a second front view of the garment of FIG. 2 illustrating an optional back strap 36. The back strap may be attached to a portion of the rear perimeter 16 and configured to facilitate the donning and removal of the support garment 10. The band 12 may be one solid continuous band of material or segments attached to each other to form a shape of a "loop" or band. As depicted in FIG. 3, a supplemental segment 38 is attached to the rear perimeter 16. FIG. 4 is a rear view of the support garment having a front bib 40 in an alternate embodiment of the present invention. The bib may provide a portion of a complete shirt or used as a front covering of the front torso of the user. The bib is attached to a lower portion of the supplemental segment 38 or the rear perimeter 16. The inner surface of the bib (laying against the user's torso) may be rubberized. The band may also have a rubberized inner surface. The rubberized material is useful to prevent slippage.

Figure 5:
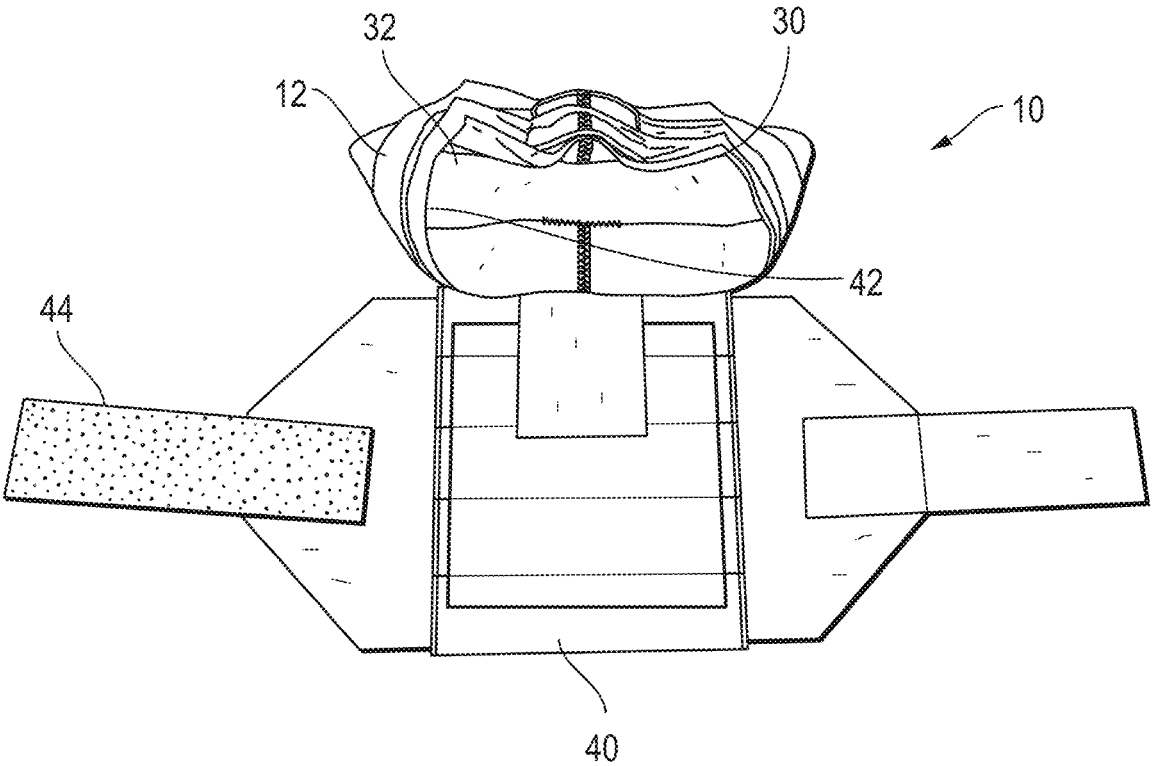
FIG. 5 is a rear view of the support garment having the front bib and a second band in an alternate embodiment of the present invention.
Figure 6:
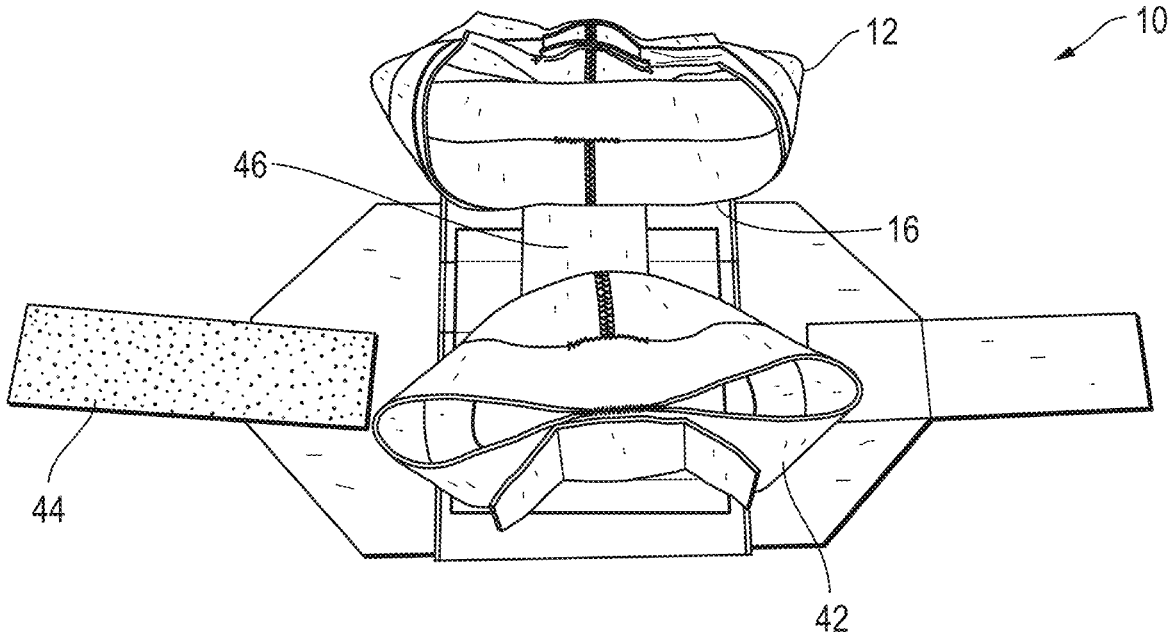
FIG. 6 is a rear view of the support garment of FIG. 5 with the second band separated from inside the first band.

FIG. 5 is a rear view of the support garment having the front bib 40 and a second band 42 in an alternate embodiment of the present invention. The support garment may have multiple bands each configured the same as band 12 of FIG. 2 where the front perimeter is attached to a seam with the rear perimeter. The second band 42 may be inserted inside the first band 12, both worn by the user to provide additional support. In the present invention, one, two or more than two bands may be positioned adjacent to each other to enable the user to wear all the bands. The multiple bands may be worn by the user at the same time, or one or more bands (for multiple bands) may be selectively worn or removed from the arms of the user. As depicted in FIG. 5, the bib 40 includes an attachment strap 44 configured to be attached around the user's back to hold the bib against the front portion of the user's torso. FIG. 6 is a rear view of the support garment 10 of FIG. 5 with the second band 42 removed from inside the band 12. The second band 12 is separately attached to the bottom of the rear perimeter 16 or the supplemental segment 38. In this embodiment, the user can select whether stronger support is needed by using both bands or separating the second band from within the first band 12 for lesser support. As shown in FIG. 6, the second band may be attached to the rear perimeter of the first band 12 by an attachment segment 46 of material.

Figure 7:
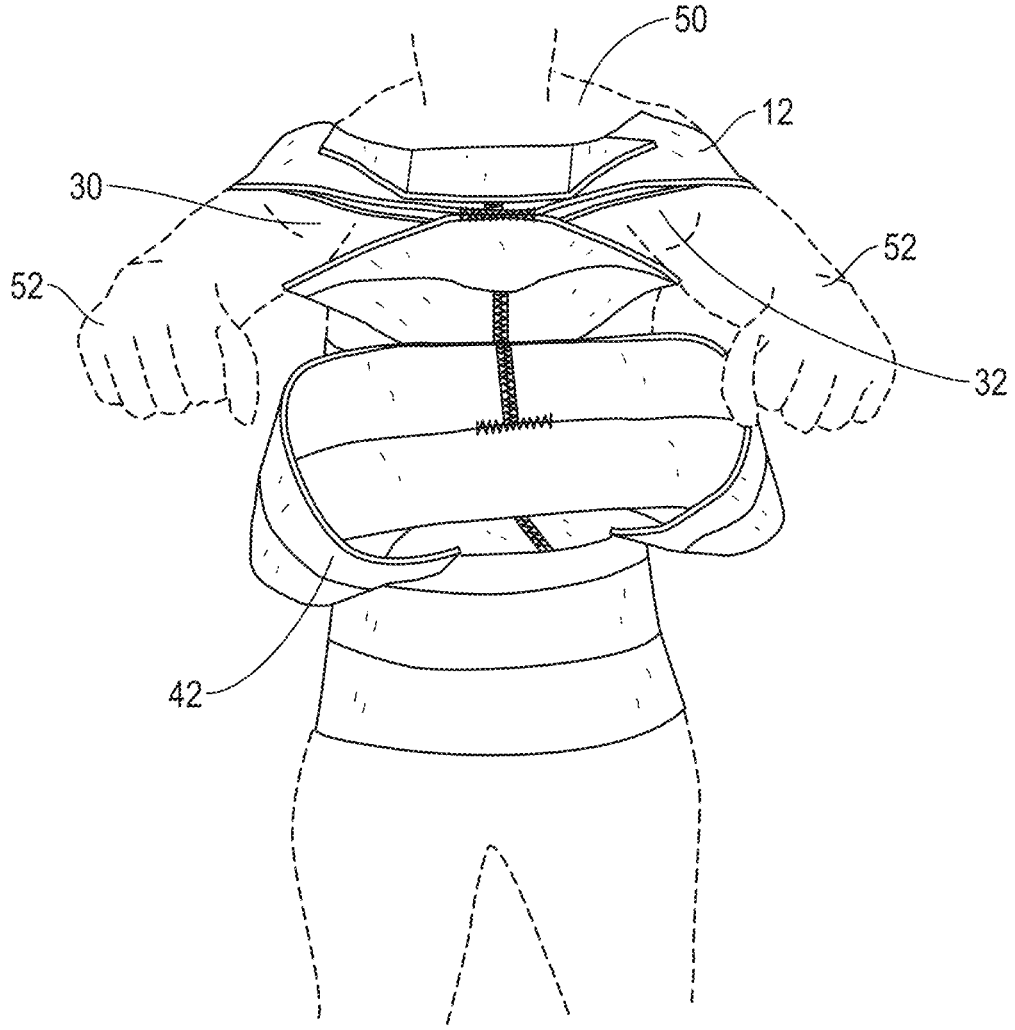
FIG. 7 is a front view of the support garment worn by a user illustrating the second band separated from the band.
Figure 8:
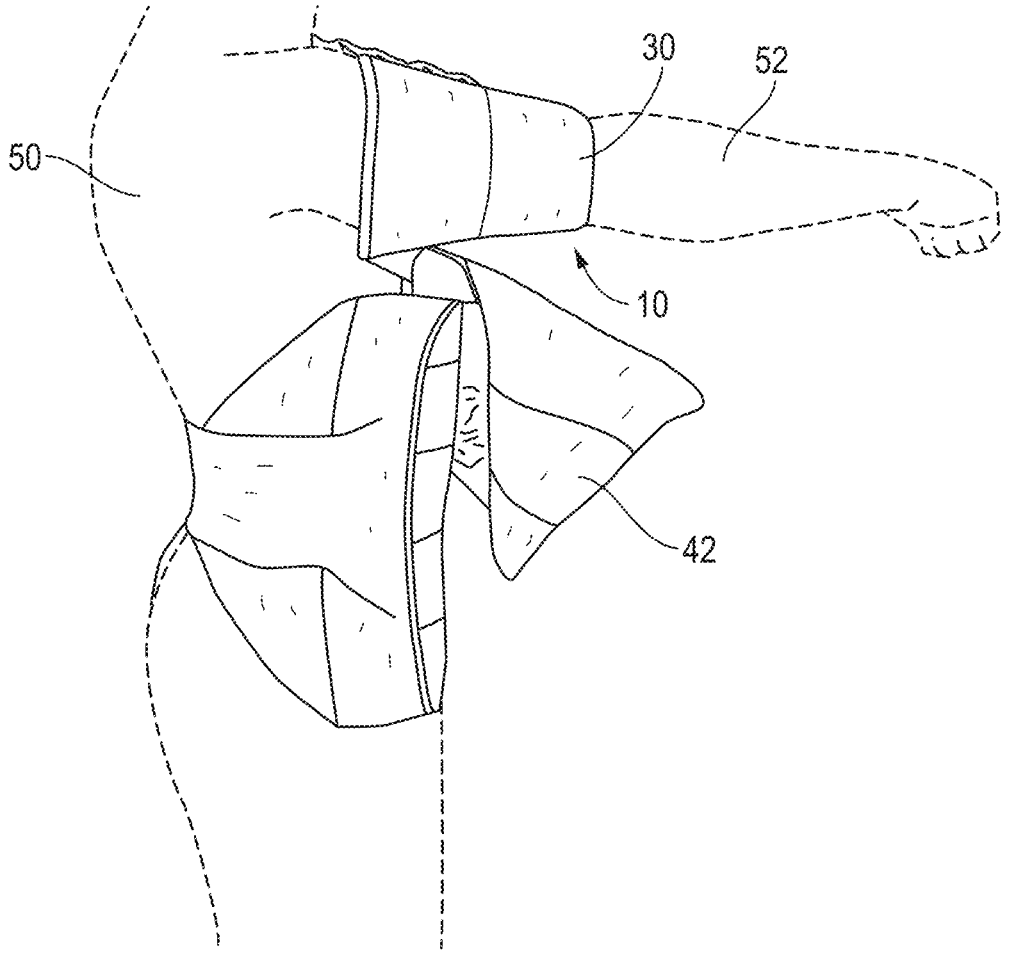
FIG. 8 is a side view of the support garment of FIG. 7.

FIG. 7 is a front view of the support garment 10 worn by a user 50 illustrating the second band 42 separated from the band 12 according to the teachings of the present invention. FIG. 8 is a side view of the support garment 10 of FIG. 7. As shown in FIG. 7, the second band 42 is separated and placed in front of the user 50. The user positions the user's arms 52 within the arm openings 30 and 32 with the arm sleeves 60 and 62 positioned above the elbows of the user.

Figure 9:
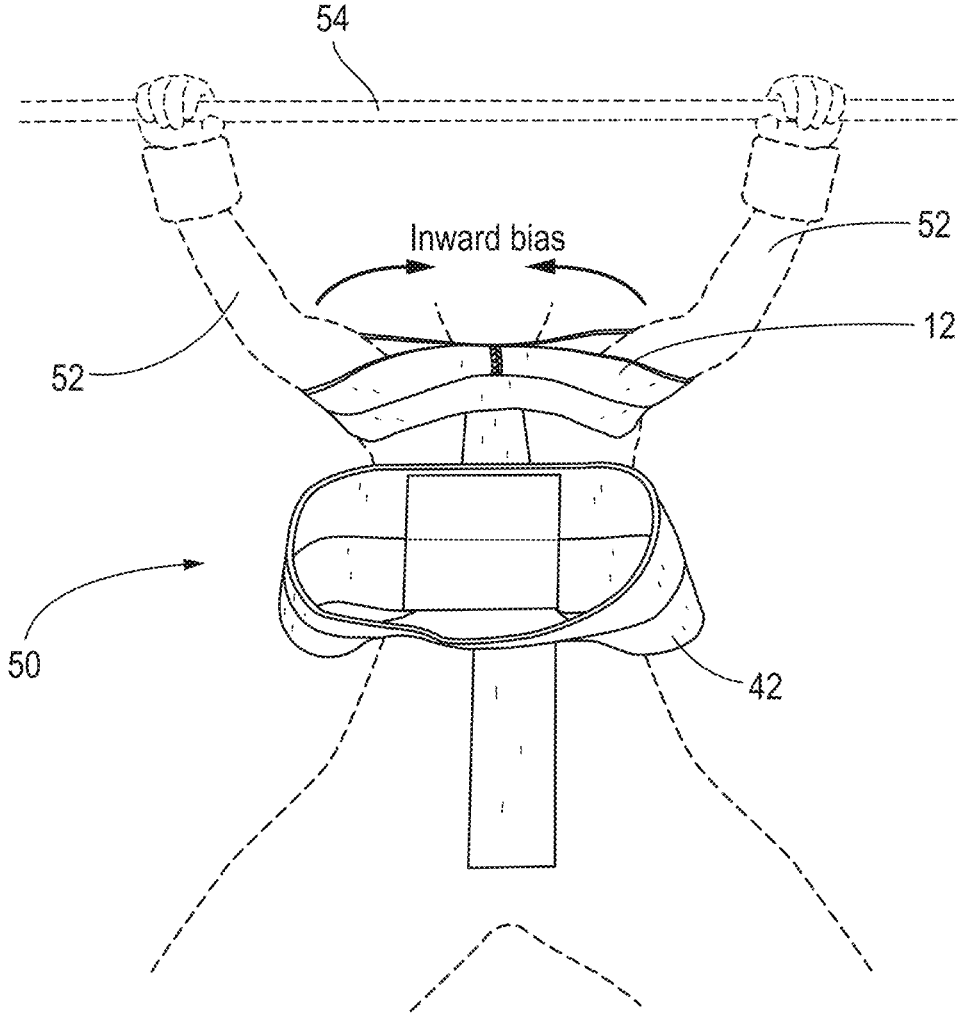
FIG. 9 illustrates a top view of the user wearing the support garment of FIG. 7 with the user's arms extended.
Figure 10:
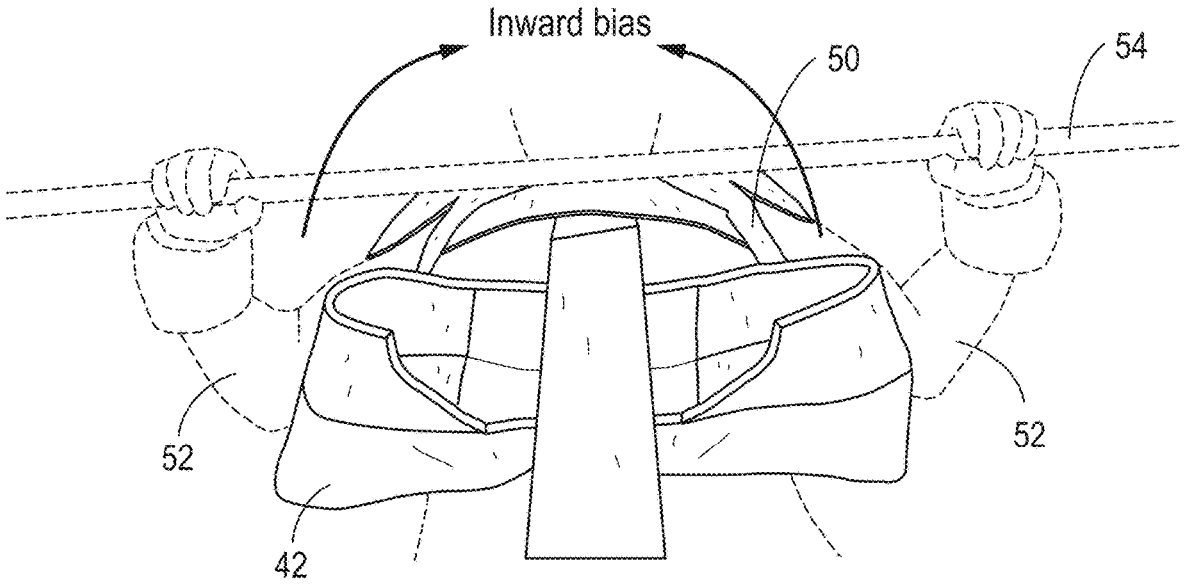
FIG. 10 illustrates a top of the user wearing the support garment with the user's arms contracted while lowering a weight.

FIG. 9 illustrates a top view of the user 50 wearing the support garment 10 of FIG. 7 with the user's arms 52 extended. As shown in FIG. 9, the second band is separated and not used by the user 50. As desired, the user may utilize and wear both band 12 and second band 42 to provide additional support during the exercise movement. With the user's arms extended upward while holding a weight bar, the arm sleeves 60 and 62 are biased in a contracted inward (and upward) position, which results in providing support to an extended position of the user's arms. FIG. 10 illustrates a top of the user 50 wearing the support garment 10 with the user's arms 52 contracted while lowering a weight 54 (bar bell and weights shown in FIG. 10) to the user's chest. When lowering the weight bar, the user has his arms contracted (bent) to allow the weight bar to be lowered against the chest of the user. Since the support garment and specifically the arm sleeves 60 and 62 provide an inward/upward bias, as the user lowers the bar, the support garment provides a force or support of the weight bar. The frontal portion 34 of the support garment lies flat against the user's chest. As the user again raises the bar, the arm sleeves assist the user in raising the bar, as the arm sleeves 60 and 62 are biased inward and upward, thereby providing support for the user to raising the weight.

With reference to FIGS. 1-10, the operation of the support garment will now be explained. The user positions the user's arms 52 through the openings 30 and 32 with the frontal portion 34 laying against the chest of the user. The arm sleeves 60 and 62 surround the upper portion of the user's arms 52. The support garment is constructed in such a fashion that the arm sleeves are biased inwardly and/or upward. Thus, with the user's arms positioned through the arm sleeves, the arms of the user are pushed inward and upward by the bias, assisting in supporting the arms in the extended position. As the user contracts his arms and lowers the weight toward his chest, the support garment provides support as a weight is lowered.

Figure 11:
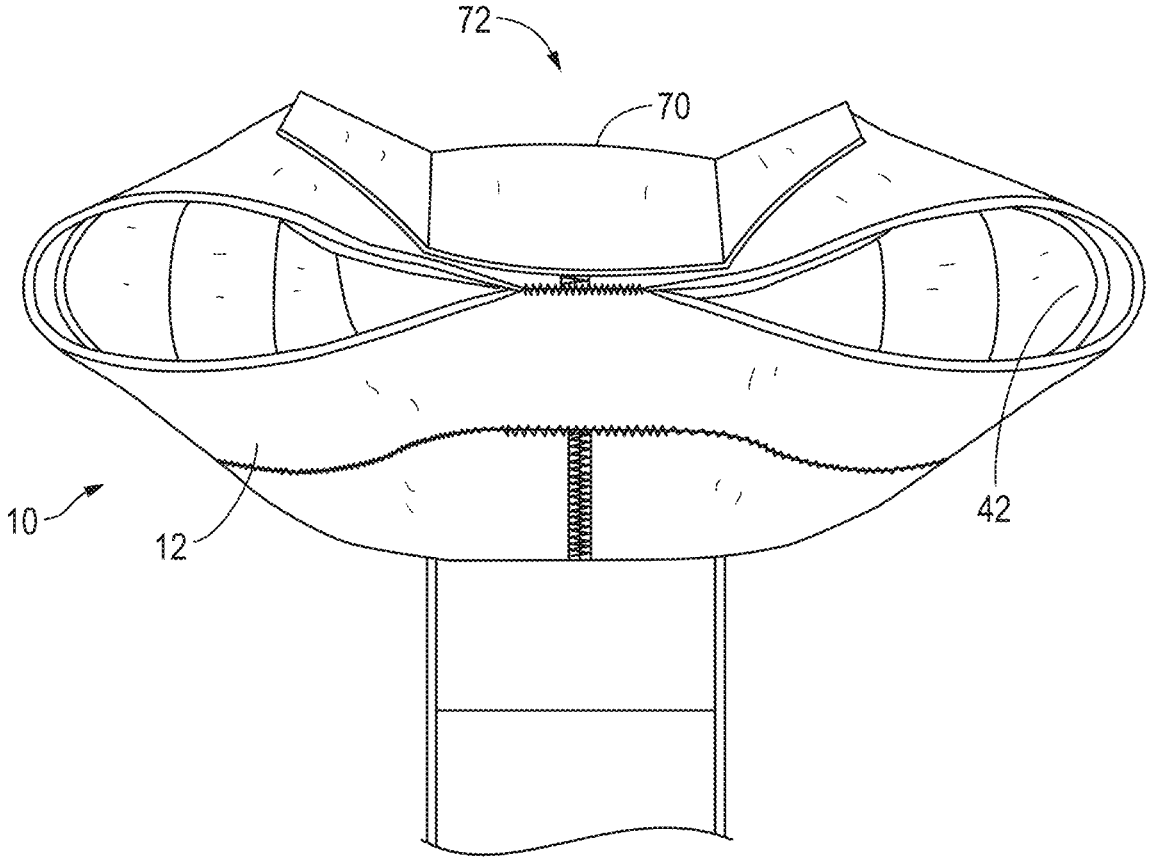
FIG. 11 is a front view of the support garment in an alternate embodiment of the present invention.

FIG. 11 is a front view of the support garment 10 in an alternate embodiment of the present invention. As depicted in FIG. 11, the second band 42 lies within the band 12, thereby providing additional support to the user. The band 12 and the second band 42 may utilize several segments of material to form the bands. Additionally, as illustrated in FIG. 11, the band may be formed to dip downward on an upper portion 70 of the band 12. With the support garment, at times the upper portion of the band rides high into the neck or throat of the user. By providing a space 72 at the top of the support garment, the support garment is prevented from riding into the user's throat or neck.

Figure 12:
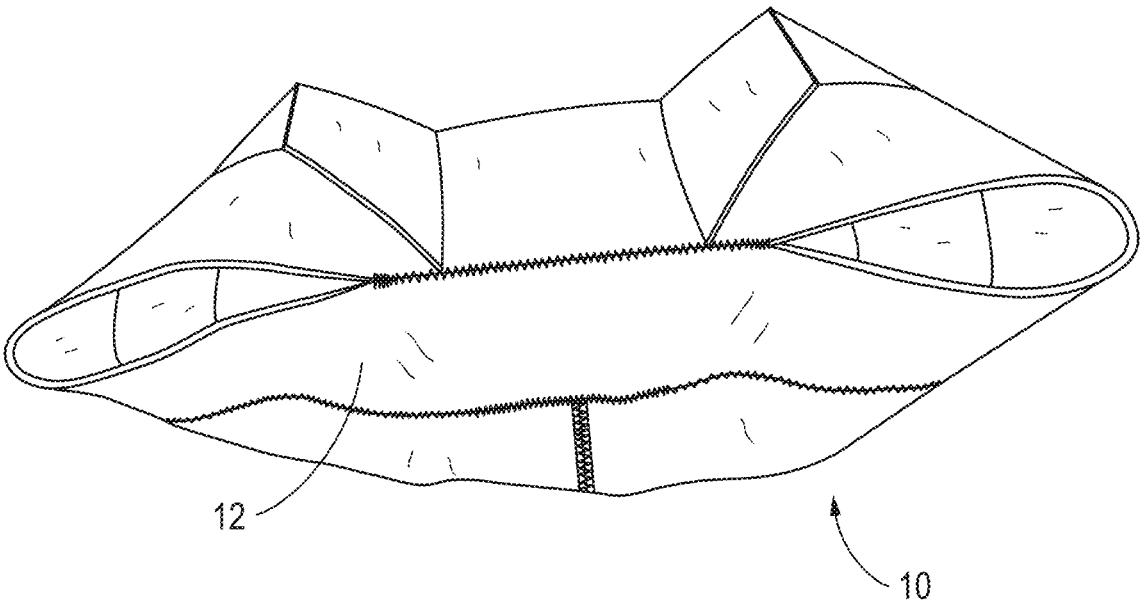
FIG. 12 is a front view of the support garment in another alternate embodiment of the present invention.

FIG. 12 is a front view of the support garment 10 in another alternate embodiment of the present invention. FIG. 12 illustrates a single band 12. The single band 12 has multiple segments forming the single band 12. The band 12 may be formed from one or more segments of material.

Figure 13:
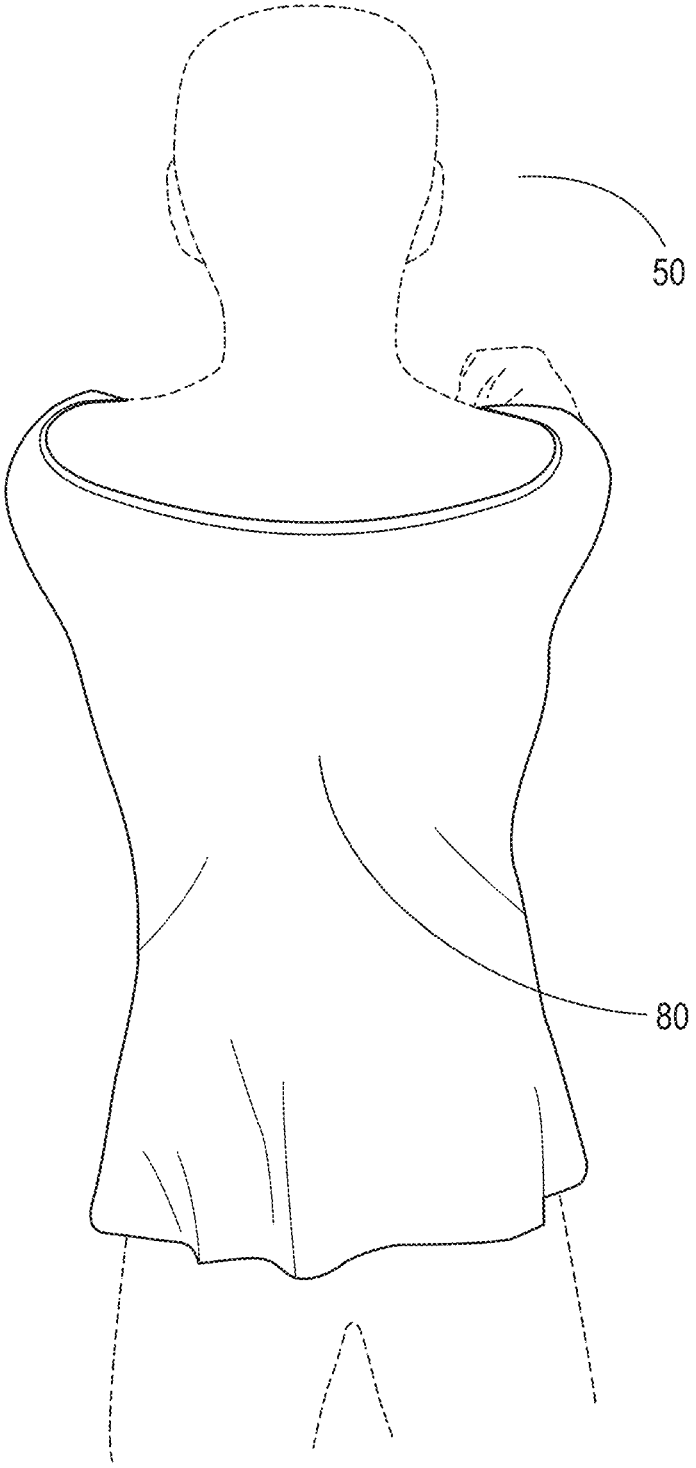
FIG. 13 is a rear view of the support garment having a backing in an alternate embodiment of the present invention.
Figure 14:
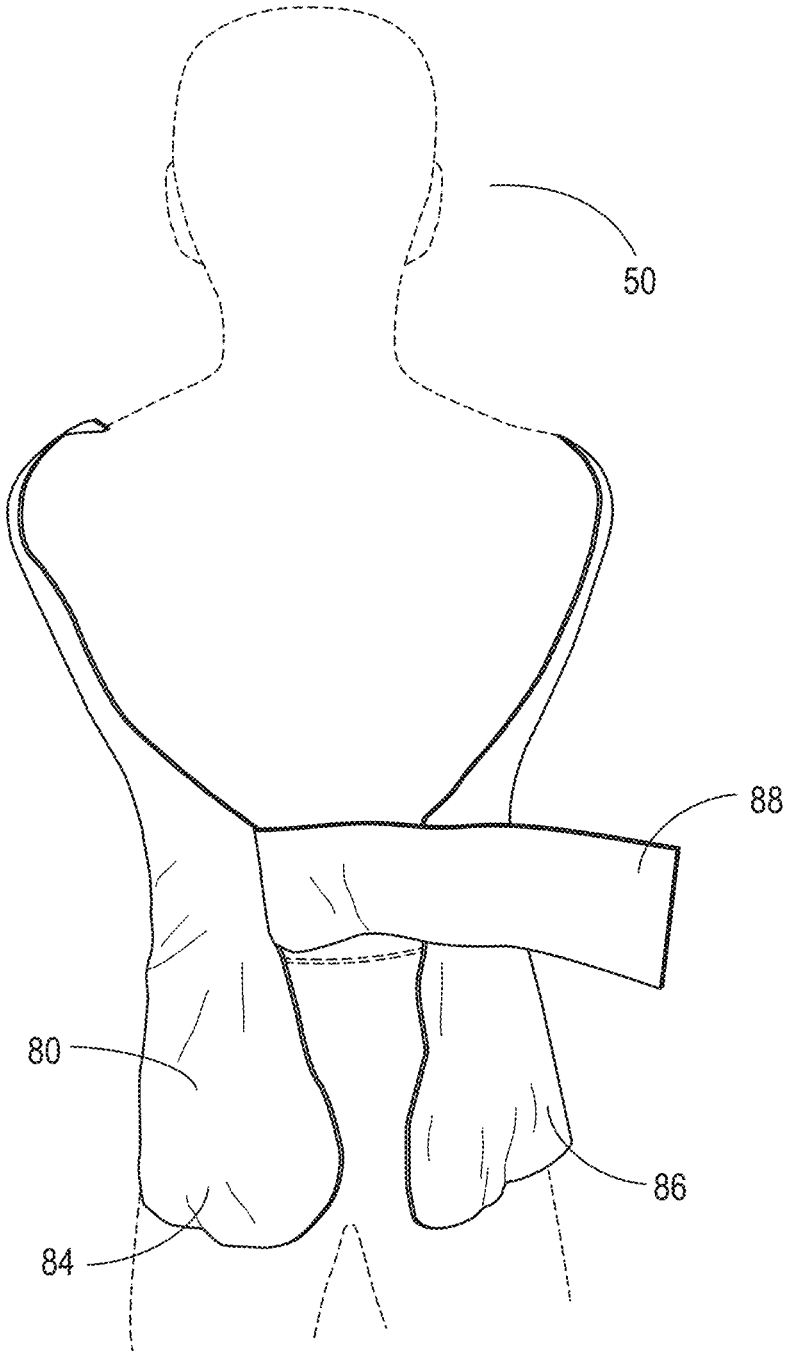
FIG. 14 illustrates the backing split into two sides.

FIG. 13 is a rear view of the support garment 10 having a backing 80 in an alternate embodiment of the present invention. The support garment may include the bib 40 (not shown in FIG. 13) and the backing 80 to form a shirt. The bib and/or backing may be utilized on any embodiment of the support garment and still remain in the scope of the present invention. FIG. 14 illustrates the backing 80 split into two sides 84 and 86. The user may close the backing with the attachment 88.

The present invention may be utilized for various situations, ranging from competitive weight events, rehabilitation where it is desired to reduce stress to the shoulders or any resistance training. The present invention is easy to put on or remove without the help of others in all embodiments. Because of the unique configuration of the upper arm sleeves, the support to the arms and shoulder enables unmatched support compared to existing devices. Additionally, when using other forms of support garments, the top of the support garment tends to ride up against the user's neck when performing an exercise. The present invention provides a solution to this problem by configuring the band of material in such a fashion as it does not ride up to the neck (or throat) of the use.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

It is therefore intended by the appended claims to cover any and all such applications, modifications and embodiments within the scope of the present invention.

What is claimed is:

1. A support garment for use during resistance training, the support garment comprising:

a band of material having a front perimeter and a rear perimeter;

wherein the front perimeter includes a first perimeter side and a second perimeter side opposite the first perimeter side;

wherein a portion of the first perimeter side of the front perimeter is attached to a portion of the second perimeter side of the front perimeter at a seam;

wherein a first opening is formed on a first seam side of the seam and a second opening is formed on a second seam side opposite the first side of the seam;

wherein an upper arm sleeve encompasses each opening for accommodating an arm of a user;

each upper arm sleeve is configured for wear on an upper arm of a user above an elbow of the user;

wherein the upper arm sleeves are biased inwardly;

wherein each upper arm sleeve is configured to position one arm in one of the upper arm sleeves and the front perimeter is configured to position the front perimeter across a chest of the user during resistance training.

2. The support garment according to claim 1 wherein the band includes a frontal portion is configured to lie flat against the chest of the user.

3. The support garment according to claim 2 wherein the frontal portion includes a rubberized surface.

4. The support garment according to claim 1 further comprising a bib section extending from a lower border of the support garment.

5. The support garment according to claim 4 wherein the bib section includes a rubberized surface.

6. The support garment according to claim 4 wherein the bib section is configured to cover a region of a front torso of the user.

7. The support garment according to claim 4 further comprising a rear backing attached to the bib section and support garment.

8. The support garment according to claim 7 wherein the rear portion is split into two sections and closed with an attachment for connecting the two sections together.

9. The support garment according to claim 1 wherein the band of material is constructed of an elastomeric material.

10. The support garment according to claim 1 wherein the band of material comprising a plurality of material segments forming the band of material.

11. The support garment according to claim 10 wherein the band is shaped to dip down when worn by the user to provide a space on an upper portion of the support garment.

12. The support garment according to claim 1 wherein the upper arm sleeves are biased upwardly.

* * * * *